US011253091B2

(12) United States Patent
Moran

(10) Patent No.: US 11,253,091 B2
(45) Date of Patent: Feb. 22, 2022

(54) SPOON

(71) Applicant: Ollwyn Agnes Moran, Dublin (IE)

(72) Inventor: Ollwyn Agnes Moran, Dublin (IE)

( * ) Notice: Subject to any disclaimer, the term of this patent is extended or adjusted under 35 U.S.C. 154(b) by 46 days.

(21) Appl. No.: 16/619,685

(22) PCT Filed: Jun. 12, 2018

(86) PCT No.: PCT/EP2018/065552

§ 371 (c)(1),
(2) Date: Dec. 5, 2019

(87) PCT Pub. No.: WO2018/229076

PCT Pub. Date: Dec. 20, 2018

(65) Prior Publication Data

US 2020/0163475 A1 May 28, 2020

(30) Foreign Application Priority Data

Jun. 12, 2017 (IE) ..... 2017/0127

(51) Int. Cl.
*A47G 21/04* (2006.01)
*A47G 21/02* (2006.01)

(52) U.S. Cl.
CPC ..... *A47G 21/04* (2013.01); *A47G 21/02* (2013.01)

(58) Field of Classification Search
CPC ..... B25G 1/102; B25G 1/10; Y10T 16/476; A47G 21/00; A47G 21/02; A47G 21/04; A47G 21/08; A47J 43/28–282; A61J 17/00
USPC .... D7/654, 688–692; 30/324–328, 147, 149, 30/150
See application file for complete search history.

(56) References Cited

U.S. PATENT DOCUMENTS 950,113 A * 2/1910 Osborn ..... B26B 21/24 30/526
3,059,252 A * 10/1962 Comeau et al. ..... A47J 43/281 30/147
3,755,895 A * 9/1973 Claasen ..... A47J 43/281 30/326

(Continued)

FOREIGN PATENT DOCUMENTS

CN 206102295 4/2017
FR 3034298 A1 * 10/2016 ..... A47G 21/02

(Continued)

OTHER PUBLICATIONS

European Patent Office; International Search Report and Written Opinion of Ser. No. PCT/EP2018/065552; 10 pages; dated Sep. 13, 2018.

(Continued)

*Primary Examiner* — Jason Daniel Prone
(74) *Attorney, Agent, or Firm* — Middleton Reutlinger

(57) ABSTRACT

A spoon (1) for infants includes a head portion (2) mounted on a handle (3) and is formed by a unitary skeletal frame (7) having a first opening (5) within which a finger grip element (6) is mounted and a second opening (9) within which a spooning element (10) having a plurality of food retaining pockets (11, 12) is mounted. A lip-engaging protrusion (13) is provided at an inner end of the spooning element (10). The finger grip element (6) has a plurality of spaced-apart finger grip holes (14).

19 Claims, 3 Drawing Sheets

(56) References Cited

U.S. PATENT DOCUMENTS

| | | | | | |
|---|---|---|---|---|---|
| 6,105,259 | A * | 8/2000 | Meyers | A47G 21/02 | 30/150 |
| 6,134,790 | A * | 10/2000 | Watson | A47G 21/02 | 30/326 |
| 6,408,524 | B1 * | 6/2002 | Lai | A47G 21/02 | 30/324 |
| 7,805,843 | B2 * | 10/2010 | Landsberger | A47G 21/02 | 30/147 |
| D695,361 | S * | 12/2013 | Roehrig | D21/525 | |
| 8,857,065 | B2 * | 10/2014 | Behbehani | A47G 21/04 | 30/324 |
| D749,919 | S * | 2/2016 | Cianciolo | D7/688 | |
| 9,480,352 | B2 * | 11/2016 | Burton | A47G 21/08 | |
| 9,694,485 | B1 * | 7/2017 | Mellin | B25G 1/10 | |
| D799,912 | S * | 10/2017 | Shively | D7/688 | |
| 9,956,815 | B2 * | 5/2018 | Shapiro | A47G 21/02 | |
| 10,130,200 | B2 * | 11/2018 | Wedderburn | A47G 21/08 | |
| 10,165,881 | B2 * | 1/2019 | Marciano | A47G 21/08 | |
| 10,244,856 | B1 * | 4/2019 | Horsky | A47G 21/02 | |
| D891,275 | S * | 7/2020 | Wechsler | D7/688 | |
| 10,736,447 | B2 * | 8/2020 | Cockrell | A47G 21/04 | |
| 10,792,227 | B2 * | 10/2020 | Moran | A61J 9/0623 | |
| 2004/0194322 | A1 * | 10/2004 | Bullard | A47G 21/08 | 30/326 |
| 2004/0194323 | A1 * | 10/2004 | Lueck | A47G 21/02 | 30/323 |
| 2004/0200076 | A1 * | 10/2004 | Tranfaglia | A47G 21/02 | 30/322 |
| 2005/0091854 | A1 * | 5/2005 | Johnson | A47G 21/00 | 30/324 |
| 2007/0039192 | A1 * | 2/2007 | Benson | A47G 21/00 | 30/327 |
| 2007/0151111 | A1 * | 7/2007 | Hakim | A47G 21/04 | 30/324 |
| 2007/0251103 | A1 * | 11/2007 | Rhodes, III | A47G 21/04 | 30/324 |
| 2008/0134520 | A1 * | 6/2008 | Kormandel | A47G 21/02 | 30/142 |
| 2008/0178471 | A1 * | 7/2008 | Rosario-Solis | A47G 21/08 | 30/165 |
| 2008/0256807 | A1 * | 10/2008 | Kirkup | A47G 21/02 | 30/147 |
| 2009/0229130 | A1 * | 9/2009 | Swierski | A47G 21/02 | 30/327 |
| 2010/0325896 | A1 * | 12/2010 | Hebebrand | A47J 43/283 | 30/150 |
| 2011/0003273 | A1 * | 1/2011 | Roggensack | A47G 21/02 | 30/123 |
| 2012/0103356 | A1 * | 5/2012 | Crisp | A47G 21/02 | 30/149 |
| 2012/0324741 | A1 * | 12/2012 | Pookrum | A47G 21/02 | 30/340 |
| 2014/0130359 | A1 * | 5/2014 | Gonterman | A47J 43/28 | 30/324 |
| 2018/0168379 | A1 * | 6/2018 | Delaforce | A47G 21/08 | |
| 2018/0257249 | A1 * | 9/2018 | Wattam | B26B 21/528 | |
| 2020/0039099 | A1 * | 2/2020 | Gratsias | B26B 21/528 | |
| 2021/0015712 | A1 * | 1/2021 | Moran | A61J 9/0669 | |

FOREIGN PATENT DOCUMENTS

| | | | | | |
|---|---|---|---|---|---|
| FR | 3034298 | A1 | | 10/2016 | |
| GB | 392877 | A | * | 5/1933 | A47G 21/04 |
| GB | 392877 | A | | 5/1933 | |
| JP | S4927589 | U | | 3/1974 | |
| JP | S5284389 | U | | 6/1977 | |
| JP | S5311116 | Y2 | | 3/1978 | |
| JP | S5339674 | U | * | 4/1978 | A47G 21/00 |
| JP | S5339674 | U | | 4/1978 | |
| KR | 20140005688 | U | | 11/2014 | |
| WO | WO-0130214 | A2 | * | 5/2001 | A47G 21/02 |
| WO | WO-2018229076 | A1 | * | 12/2018 | A47G 21/02 |
| WO | WO2018229076 | A1 | | 12/2018 | |

OTHER PUBLICATIONS

China National Intellectual Property Administration: Office Action issued for Application No. 201880045370.3 dated May 26, 2021. 27 Pages.

* cited by examiner

SPOON

INTRODUCTION

This invention relates to hand held implements generally, and in particular to a spoon for infants.

When first learning to feed themselves infants often have difficulty using spoons. In particular, gripping the spoon can cause problems. Also, infants tend to have difficulty in orienting the spoon correctly to pick up food and often end up merely pushing the food around the plate. Further, until the infant learns to keep the spoon level, very often food will slide off the spoon as the infant lifts the spoon from the plate up to their mouth, which can be very frustrating for the infant.

Many disabled and elderly people also have difficulty in gripping cutlery and other implements due to the weakness of their grip.

The present invention is directed towards overcoming these problems.

It is known from GB 2442556 to provide an eating utensil formed substantially of rubber having a handle with a supporting portion having a number of slots to provide fork-like qualities, but at the same time, leaving no sharp parts in order to be safe for use by a small child. JP 2004249042 discloses a spoon or fork for an infant having grooves in the handle to facilitate gripping by an infant. WO 2011/123491 discloses a helper utensil, such as a spoon, with a handle which can be held simultaneously by a child and an adult to guide the child when feeding.

SUMMARY OF THE INVENTION

According to the invention there is provided a spoon including a head portion mounted on a handle, the handle incorporating a finger grip element. Advantageously, this allows a user to more easily and more securely grip the handle.

In one embodiment of the invention the handle comprises a handle frame defining an opening within which is mounted the finger grip element.

The head portion may be any suitable shape, and may, in some cases, be generally flat.

In another embodiment of the invention, the head portion has a spooning element having a plurality of food retaining pockets. Thus it is easier to pick up and retain food on the spoon.

In another embodiment the head portion has a head frame defining an opening within which is mounted the spooning element.

In another embodiment, the head portion includes a lip-engaging protrusion. Advantageously, this lip-engaging protrusion is designed to touch off the top lip at the cupids bow and will stimulate the suck reflex. Thus, the spoon of the invention uses the body's natural developmental reflexes to further enable easy transition to self-feeding, using primitive and postural reflexes.

In another embodiment, the lip-engaging protrusion is provided at an inner end of the head portion.

In another embodiment, the lip-engaging protrusion is a mound at an inner end of the spooning element.

In another embodiment, the head portion and the handle are formed by a unitary skeletal frame having a first opening within which the finger grip element is mounted and a second opening within which the spooning element is mounted.

In another embodiment, the skeletal frame comprises a figure eight configuration having an elliptical handle frame and an elliptical head frame interconnected by a narrowed neck portion.

In another embodiment, the handle frame and the head frame are coplanar.

In another embodiment, the finger grip element has a plurality of spaced-apart finger grip holes. These conveniently facilitate securely gripping the handle.

In another embodiment, the finger grip holes are circular. It will be appreciated that holes of other shapes may be provided in alternative embodiments of the invention.

In another embodiment, peripheral edges of the finger grip holes are curved or chamfered.

In another embodiment, finger grip holes of different size are provided on the finger grip element.

In another embodiment, the finger grip element extends outwardly of the handle frame.

In another embodiment, a number of scalloped finger receiving grooves are provided in the finger grip element.

In another embodiment, each finger grip hole has an associated finger receiving groove aligned therewith.

In another embodiment, the finger grip element includes a message panel.

In a further embodiment, mounting bands at outer sides of the finger grip element engage in complementary grooves in the handle frame to stretch the finger grip element on the handle frame.

In another embodiment, the opening in the handle frame is oval.

In another embodiment, the finger grip element comprises a resiliently deformable material.

In another embodiment, the finger grip element comprises silicone or a similar rubber-like material.

In another embodiment, the handle frame comprises a stiff but flexible material. Preferably the handle frame comprises a plastics material.

In another embodiment food retaining pockets are provided on opposite sides of the spooning element. This makes it easier for the infant to pick up food with the spoon.

In another embodiment, peripheral edges of the food retaining pockets are curved or chamfered.

In another embodiment, a number of food retaining pockets of different size are provided.

In a further embodiment, mounting bands at outer sides of the spooning element engage in complementary grooves in the head frame to mount the spooning element on the head frame.

In another embodiment, the spooning element projects outwardly of the head frame.

In another embodiment, the opening in the head frame is oval.

In a further embodiment, the head frame comprises a stiff but flexible material.

In another embodiment, the head frame comprises a plastics material.

In another embodiment, the handle frame and the head frame are integral.

In another embodiment, the spooning element comprises a resiliently deformable material.

In another embodiment, the spooning element comprises silicone or a similar rubber-like material.

In another aspect the invention provides a spoon including a head potion mounted on a handle, the head portion having a spooning element having a plurality of food retaining pockets.

In another embodiment the head portion has a head frame defining an opening within which is mounted the spooning element.

In another aspect, the invention provides a spoon including a head portion mounted on a handle, the head portion having a lip-engaging protrusion at an inner end of the head portion.

BRIEF DESCRIPTION OF THE DRAWINGS

The invention will be more clearly understood by the following description of some embodiments thereof, given by way of example only, with reference to the accompanying drawings in which.

DETAILED DESCRIPTION OF THE PREFERRED EMBODIMENTS

Figure 1:
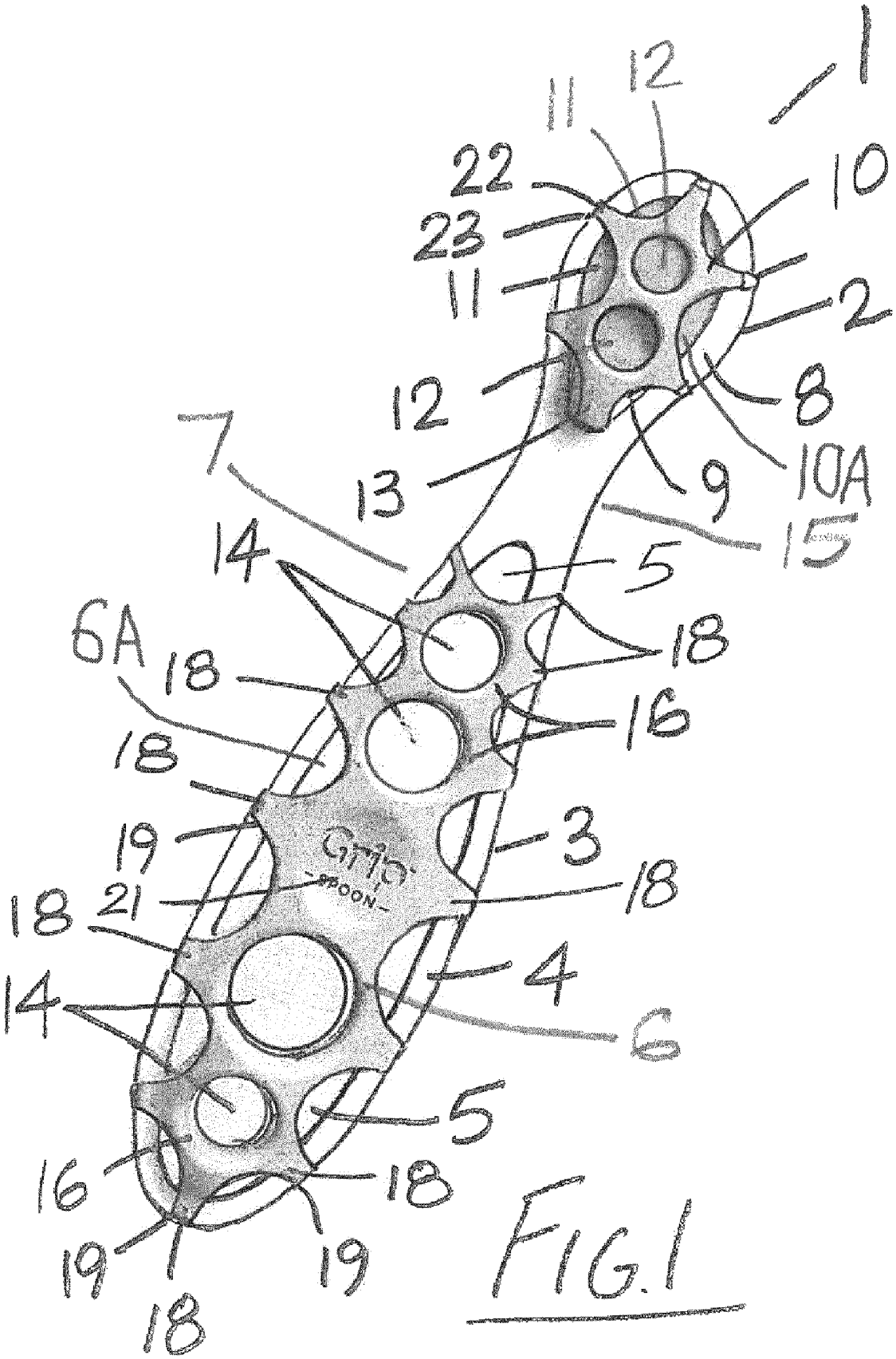
FIG. 1 is a perspective view of a spoon according to the invention.
Figure 2:
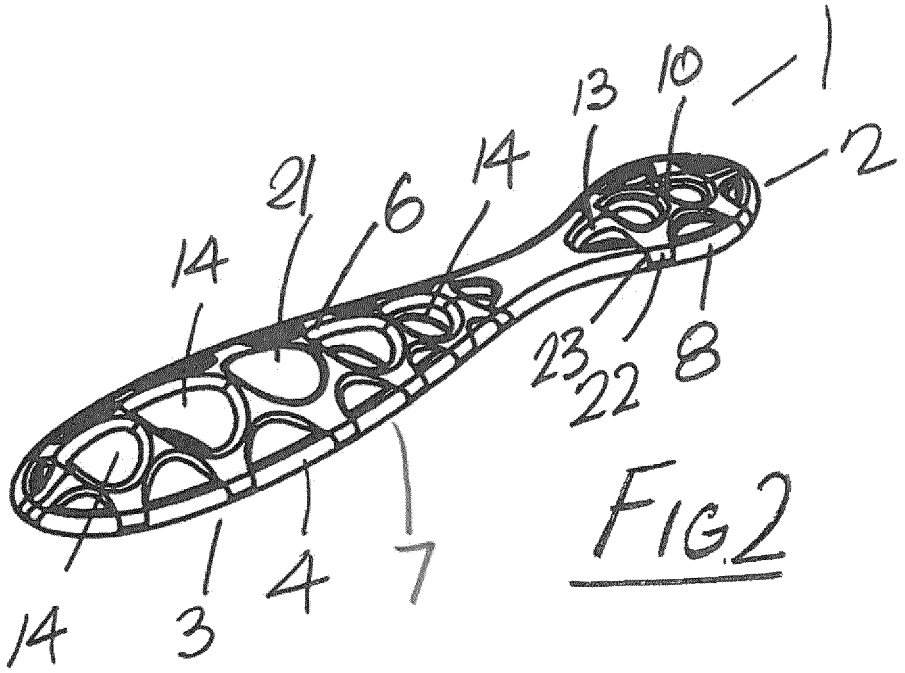
FIG. 2 is another perspective view of the spoon.
Figure 3:
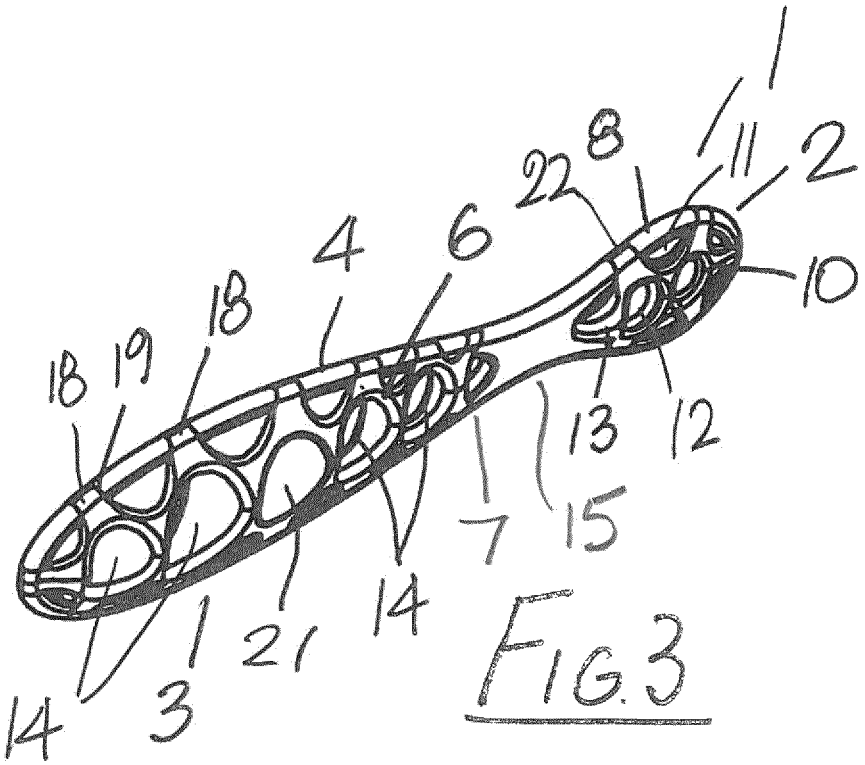
FIG. 3 is a further perspective view of the spoon.
Figure 7:
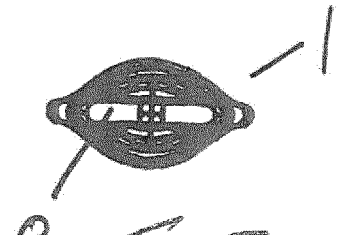
FIG. 7 is a plan view of the spoon.

Referring to the drawings, there is provided a spoon according to the invention indicated generally by the reference numeral 1. The spoon 1 comprises a head portion 2 mounted on a handle 3. The handle 3 comprises a handle frame 4 defining an opening 5 within which is mounted a finger grip element 6. Similarly, the head portion 2 has a head frame 8 defining an opening 9 within which is mounted a spooning element 10 having a plurality of food-retaining pockets 11, 12. Each of finger grip element 6 and spooning element 10 may have one or more bottom portions 6A, 10A that do not project outwardly of the skeletal frame 7.

The handle frame 4 and head frame 8 are integral and are formed of a stiff but flexible plastics material. That is it will bend and flex. The head portion 2 and the handle 3 form a unitary skeletal frame 7 having a first opening 5 within which the finger grip element 6 is mounted and a second opening 9 within which the spooning element 10 is mounted. The skeletal frame 7 comprises a figure eight configuration having an elliptical handle frame 4 and an elliptical head frame 8 interconnected by a narrowed neck portion 15. The handle frame 4 and the head frame 8 are coplanar.

Both the opening 5 in the handle frame 4 and the opening 9 in the head frame 8 have a generally oval shape. A plurality of spaced-apart finger grip holes 14 are provided in the finger grip element 6 and extend through the finger grip element 6. These finger grip holes 14 may be provided in a range of sizes as shown and conveniently may be generally circular with chamfered peripheral edges 16. The finger grip holes 14 can of course be provided in any desirable shape.

A plurality of spaced-apart mounting bands 18 at outer sides of the finger grip element 6 engage within complementary grooves 19 spaced around the handle frame 4 to stretch the finger grip element 6 on the handle frame 4 and secure the finger grip element 6 to the handle frame 4.

Figure 6:
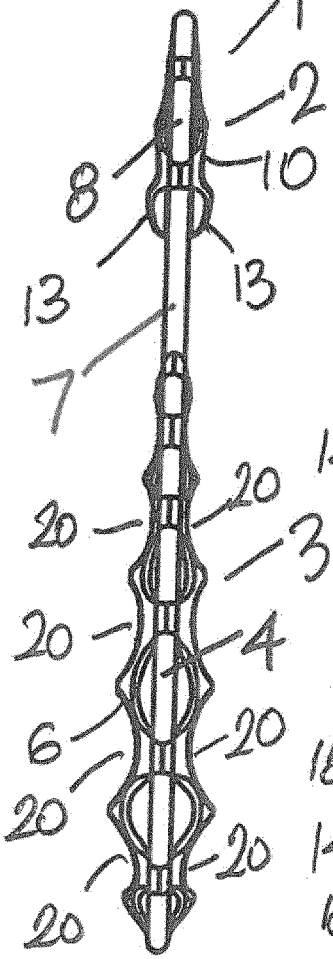
FIG. 6 is another side elevational view of the spoon.
Figure 4:
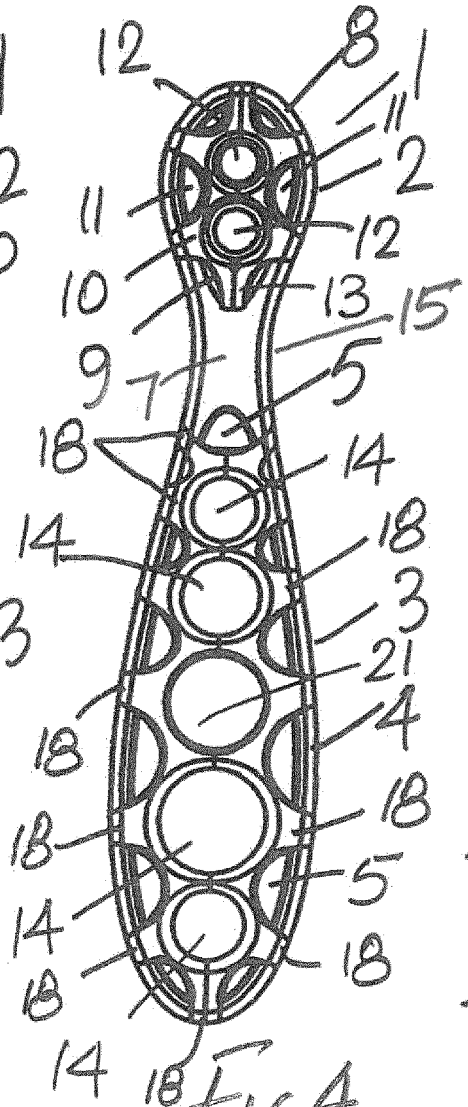
FIG. 4 is an elevational view of the spoon.
Figure 5:
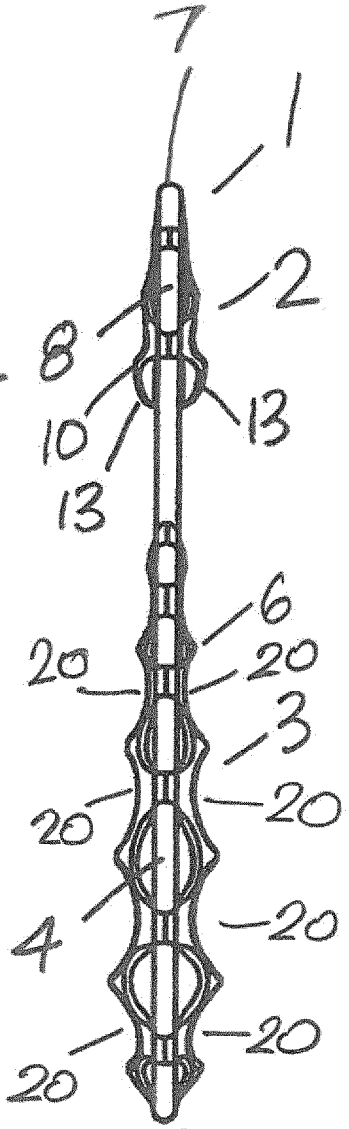
FIG. 5 is a side elevational view of the spoon.
Figure 8:
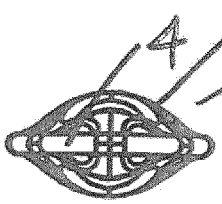
FIG. 8 is an underneath plan view of the spoon.

It will be noted, particularly from FIGS. 5 and 6 that the finger grip element 6 extends outwardly of the handle frame 4 at opposite sides of the handle frame 4. A number of scalloped finger receiving grooves 20 are provided in the finger grip element 6. Each finger grip hole 14 has an associated finger receiving groove 20 aligned therewith. The finger receiving grooves 20 further assist in gripping the handle 3 securely and naturally feed fingers to the finger grip holes 14.

A message panel 21 may be provided on the finger grip element 6 for reception of indicia relating to the name of the product, or an advertising message.

The finger grip element 6 preferably comprises a resiliently deformable material such as silicone or a similar rubber-like material.

A plurality of separate food retaining pockets 11, 12 of different shape and size are provided on the spooning element 10. Some of the pockets 12 are formed within the material of the spooning element 10 and other pockets 11 are formed at edge portions of the spooning element 10 which cooperate with the head frame 8 to define the pockets 11. Food retaining pockets 11, 12 are provided on opposite sides of the spooning element 10. It will be noted particularly from FIG. 5 and FIG. 6 that the spooning element 10 projects outwardly at opposite sides of the head frame 8.

It will be noted that at an inner end of the spooning element 10, there may be provided a lip-engaging protrusion or mound 13. As best seen in FIG. 5 and FIG. 6, the lip-engaging mound 13 is provided on opposite sides of the spooning element 10 so that whichever orientation the infant holds the spoon 1, as the head portion 2 is inserted into the infant's mouth, a lip-engaging mound 13 will touch off the top lip of the infant at the cupid's bow to stimulate the suck reflex.

Mounting bands 22 at outer sides of the spooning element 10 engage in complementary grooves 23 spaced around the head frame 8 to mount the spooning element 10 on the head frame 8. The head frame 8 is integral with the handle frame 4 and likewise comprises a stiff but flexible plastics material.

In use, an infant can more easily and securely grip and hold the spoon 1 by inserting their fingers into the finger receiving grooves 20 and through the finger grip holes 14 in the handle 3. The spoon 1 can be used in the usual fashion so that the infant can feed themselves. In this case the separate pockets 11, 12 in the head portion 2 help to retain food material and stop it slipping off the head portion 2 before the infant has time to insert the head portion 2 into their mouth. Also, providing food retaining pockets 11, 12 on opposite sides of the head portion 2 makes it easier for the infant to pick up food from a plate.

It will be noted that all edges of the various spoon components are rounded and smooth for comfort. The mesh construction of the finger grip element 6 with a plurality of finger grip holes 14 and finger receiving grooves 20 conveniently facilitates an infant in securely gripping the handle 3 of the spoon 1.

Further, by selecting appropriate materials for the head portion and handle, this can provide great flexibility of the various components in a variety of directions. Various materials could be used for the frame 4, 7, 8, the finger grip element 6 and the spooning element 10. Preferably, the finger grip element 6 and spooning element 10 are of softer material than the frame 4, 7, 8.

Any or all of the skeletal frame, the finger grip element and the spooning element could be stiff or rigid, although some flexibility is preferable in each component.

While the spoon 1 of the invention has been described for use with infants to assist them at feeding time, it is envisaged that a similar type of spoon, or indeed other implements such as a knife and fork for example may be provided for other children or adults who have difficulty in gripping conventional cutlery elements. Indeed the handle arrangement may be usefully applied to a wide range of hand-held implements where it is desirable to facilitate secure gripping of the handle.

The invention is not limited to the embodiments hereinbefore described which may be varied in both construction and detail within the scope of the appended claims.

The invention claimed is:

1. A spoon, the spoon comprising:

a skeletal frame including a handle frame and a head frame, the head frame including an opening extending through the head frame; and a spooning element mounted to the head frame, the spooning element including a first portion that extends through the opening in the head frame and a second portion that wraps around the head frame, the spooning element including a plurality of food retaining pockets.

2. The spoon of claim 1, wherein first and second portions of the plurality of food retaining pockets are respectively provided on first and second sides of the spooning element.

3. The spoon of claim 2, wherein the second portion of the spooning element includes a plurality of mounting bands and the head frame includes a plurality of complementary grooves configured to receive the plurality of mounting bands.

4. The spoon of claim 1, wherein peripheral edges of at least a first portion of the plurality of food retaining pockets are curved or chamfered, and wherein at least a second portion of the plurality of food retaining pockets are of different sizes from one another.

5. The spoon of claim 1, wherein the spooning element includes a lip-engaging protrusion, and wherein the lip-engaging protrusion is a mound at an inner end of the spooning element.

6. The spoon of claim 1, wherein the spooning element projects outwardly of the head frame at opposite sides of the head frame, and wherein the spooning element comprises a resiliently deformable material.

7. The spoon of claim 1, wherein the opening in the head frame is a first opening, wherein the handle frame includes a second opening extending through the handle frame, and wherein the spoon further comprises a finger grip element mounted to the handle frame, the finger grip element including a first portion that extends through the second opening in the handle frame and a second portion that wraps around the handle frame.

8. The spoon of claim 7, wherein the skeletal frame comprises a figure eight configuration, wherein the handle frame is elliptical and the head frame is elliptical, and wherein the handle frame and head frame are interconnected by a narrowed neck portion.

9. The spoon of claim 7, wherein the handle frame and the head frame are coplanar and integral.

10. The spoon of claim 7, wherein the finger grip element has a plurality of spaced-apart finger grip holes.

11. The spoon of claim 10, wherein the finger grip holes are circular and/or wherein peripheral edges of the finger grip holes are curved or chamfered.

12. The spoon of claim 10, wherein at least a portion of the finger grip holes are of different sizes from one another.

13. The spoon of claim 10, wherein the finger grip element has at least one finger receiving groove and one of the finger grip holes is positioned in the at least one finger receiving groove.

14. The spoon of claim 7, wherein the finger grip element projects outwardly of the handle frame at opposite sides of the handle frame and/or includes a message panel.

15. The spoon of claim 7, wherein the finger grip element includes a plurality of scalloped finger receiving grooves.

16. The spoon of claim 7, wherein the second portion of the finger grip element includes a plurality of mounting bands and the handle frame includes a plurality of complementary grooves configured to receive the plurality of mounting bands.

17. The spoon of claim 7, wherein the first and second openings are oval.

18. The spoon of claim 7, wherein the finger grip element comprises a resiliently deformable material, and wherein the skeletal frame comprises a stiff but flexible material.

19. An eating implement, the eating implement comprising:

a skeletal frame including a handle frame and a head frame, the handle frame including an opening extending through the handle frame; and a finger grip element mounted to the handle frame, wherein the finger grip element is formed of a resiliently deformable material that is softer than that of the skeletal frame, wherein the finger grip element includes a first portion that extends through the opening in the handle frame and a second portion that wraps around the handle frame, and wherein the second portion of the finger grip element includes a plurality of mounting bands and the handle frame includes a plurality of complementary grooves configured to receive the plurality of mounting bands.

* * * * *